United States Patent [19]

Heiman

[11] 4,106,610

[45] Aug. 15, 1978

[54] COIN APPARATUS HAVING MULTIPLE COIN-DIVERTING GATES

[75] Inventor: Frederic P. Heiman, Delran, N.J.

[73] Assignee: Mars, Incorporated, Mc Lean, Va.

[21] Appl. No.: 694,050

[22] Filed: Jun. 7, 1976

[51] Int. Cl.[2] ..... G07F 3/00

[52] U.S. Cl. ..... 194/97 R; 194/1 C; 194/100 A

[58] Field of Search ..... 133/1 A, 3 R, 8 A, 2, 133/4 R, 4 A; 194/97 R, 99, 100 R, 100 A, 102, DIG. 15, 1 C, 1 D

[56] References Cited

U.S. PATENT DOCUMENTS

| | | | |
|---|---|---|---|
| 2,571,596 | 10/1951 | Meredith et al. | 133/2 X |
| 3,653,481 | 4/1972 | Boxall et al. | 194/100 A |
| 3,797,628 | 3/1974 | Fougere et al. | 194/99 |
| 3,918,563 | 11/1975 | Schwippert et al. | 194/100 A |

*Primary Examiner*—Robert B. Reeves
*Assistant Examiner*—Francis J. Bartuska
*Attorney, Agent, or Firm*—Davis, Hoxie, Faithfull & Hapgood

[57] ABSTRACT

A coin apparatus including a structure for defining a coin path, a coin presence sensor adjacent the coin paths, a first gate for separating acceptable coins from unacceptable coins and a second gate for sorting acceptable coins in which the second gate is arranged to minimize coin jams which might otherwise disable the apparatus.

12 Claims, 5 Drawing Figures

COIN APPARATUS HAVING MULTIPLE COIN-DIVERTING GATES

The present invention is concerned with an improvement in coin handling apparatus suitable for incorporation in a coin operated vending machine. Typically, such coin handling apparatus receives coins of various denominations, determines the denomination and authenticity of the coins, rejects slugs and coins of unacceptable denominations, sums the denominations of acceptable coins to a value equal to or in excess of the price of the item to be vended, produces change in an amount equal to the excess of the value of the accepted coins over the price of the item selected and produces a signal to initiate vending.

A coin inserted into a vending machine having such a coin handling apparatus enters the apparatus and moves by gravity along one or more coin supporting tracks which, together with side walls, define coin passageways and establish coin paths. Sensors arranged along the coin path are employed to measure one or more physical properties of the coin such as electrical conductivity, diameter, etc. Circuitry associated with the sensors determines whether the coin is an authentic coin of an acceptable denomination.

The improvement of the present invention is concerned with a method and apparatus having at least two moveable gates, including a first gate for separating acceptable authentic coins from unacceptable coins and other objects, and a second gate for sorting the acceptable coins in accordance with various criteria. The present invention is particularly directed to a substantial reduction in the disablement of the coin handling apparatus which may result from coin jams in the vicinity of and downstream of the gate used for sorting acceptable coins, by providing a direct path to a cash box except when the sorting gate is used to divert coins from that path. This sorting gate is activated to divert coins only during a limited period of time, so that coins moving more slowly than normal through the apparatus are sent directly to the cash box. Abnormally slow coins are likely to be bent, nicked, dirty, sticky, etc., and are therefore much more likely to jam coin separators, coin containers, coin dispensers and coin dispenser loading apparatus than coils which move at normal velocity. By use of a sorting gate in accordance with this invention, the likelihood of such coin jams is greatly reduced and when such coin jams do occur, they are usually prevented from interfering with the normal operation of the remainder of the apparatus. While the invention is described in connection with embodiments having two coin diverting gates, the invention is also applicable to apparatus having a greater number of such gates.

According to the present invention, a coin presence sensor is located adjacent the coin path in the coin apparatus. It can be a part of a coin physical property examining means or a separate coin presence sensor in various embodiments of this invention.

A first gate, is provided for separating acceptable coins from other coins and objects on the coin path. The first gate is moveable between a first position permitting coins on the path to enter only a rejected coin path and a second position permitting coins to enter only an accepted coin path. First activator means are provided for moving the first gate between its first and second positions. In the absence of activation of the first gate by the first activator means, the first gate is held in its first position in which coins can only enter the rejected coin passageway.

A second gate is provided on the accepted coin path, downstream of the first gate and the coin presence sensor. The second gate is moveable in response to the output of the coin presence sensor between a first position permitting coins on the accepted coin path to enter only a first cash box passageway and a second position permitting coins on the accepted coin passageway to enter only a coin container filling mechanism passageway. Second activator means are provided for moving the second gate between its first and second positions. In the absence of activation by the second activator means, the second gate is held in its first position in which accepted coins can enter only the first cash box passageway.

The period of activation of each of the gates is controlled so that they each can be held in their second position for a sufficient period for acceptable coins moving at a normal velocity to pass the gate, and can be returned to the first position in time to prevent slow moving coins from passing the second gate into the coin container filling apparatus passageway. The action of the second activator can be inhibited or limited to a very brief period of time, so that all accepted coins are permitted to pass the second gate to the first cash box passageway when a coin container is full or the coin container filling mechanism passagewy is jammed, as will be apparent from the detailed description below.

Throughout this specification the term "coin" is intended to mean genuine coins, tokens, counterfeit coins, slugs, washers, and any other item which may be used in an attempt to use coin-operated devices.

DETAILED DESCRIPTION

Figure 1:
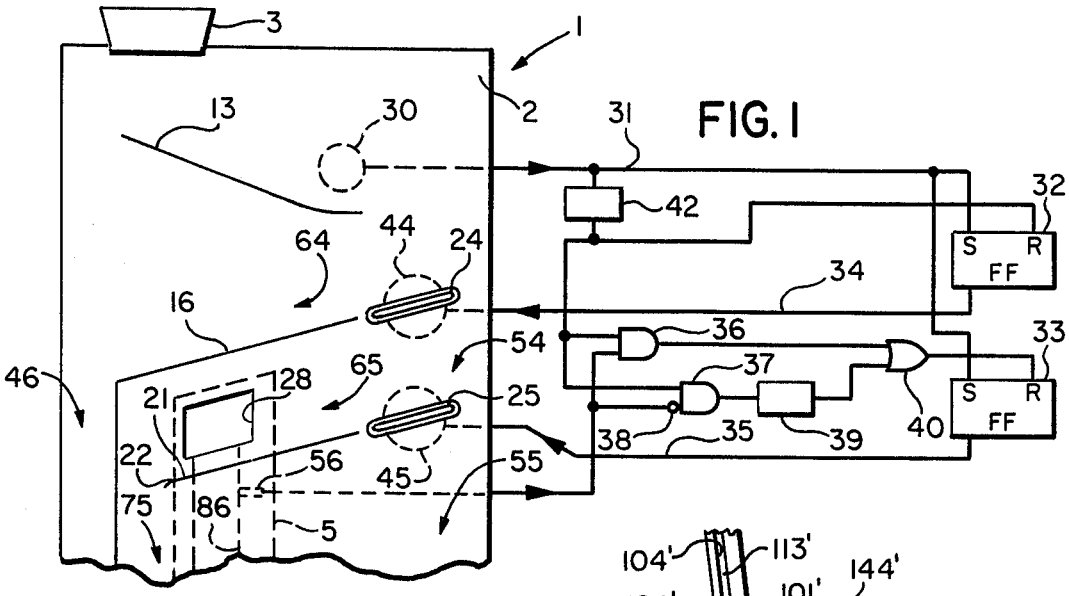
FIG. 1 is a simplified schematic diagram of an apparatus including the present invention.

Referring to FIG. 1, a coin inserted into the coin-receiving slot (not shown) of a vending machine is directed into a hopper 3 of the coin apparatus 1. The coin drops from the hopper 3 onto and rolls down the upper surface of a track 13. As the coin rolls downstream along the track 13, it is identified by a coin presence sensor 30 which is connected by a wire 31 to one or more electronic switches such as flip-flops 32 and 33. By the time the coin reaches the end of the track 13, the presence of the coin has been identified and the coin has been further identified as either acceptable or unacceptable.

Upon leaving the track 13, the coin falls toward the first gate 24. The first gate 24 is intended to separate acceptable coins from unacceptable coins in response to a first electrical signal on wire 34 which controls the first gate activator means, a solenoid 44. The first gate 24 is moveable by the solenoid 44 between two positions. In the embodiment of FIG. 1, the first gate is arranged to protrude in its first position from sidewall 2, thereby obstructing the entrance to the accepted coin passageway 54 and permitting coins to pass only into the rejected coin passageway 64. When the first gate 24 is activated it is moved into its second position, retracted from obstructing the entrance to the accepted coin passagewy 54. The coins can then pass only into the accepted coin passageway 54.

Downstream of the first gate is a second gate 25. The second gate is intended to direct certain accepted coins to the coin container filling mechanism 5 via the coin container passageway 65 in the second position of the second gate 25 and permit all other accepted coins to pass to the cash box (not shown) via a first cash box passageway 55 in the first position of the second gate 25.

When the second gate 25 is not activated, it is held in its first position, retracted from obstructing the entrance to the first cash box passageway 55. When the second gate 25 is activated by a second activator means, solenoid 45, it protrudes from the sidewall 2 or the other sidewall (not shown) across the entrance to the first cash box passageway 55, obstructing the entrance to the first cash box passageway 55 and permitting accepted coins to pass only to the coin container passageway 65.

Although the details of coin containers and their filling mechanisms do not form a part of the present invention; portions of a coin container filling mechanism 5 and a coin container in the form of a coin tube 86 are shown in FIG. 1. Further details of coin tubes and coin tube filling may be found in U.S. Pat. Nos. 3,906,965 and 3,844,297. When the second gate 25 is activated and in its second position, it causes the accepted coin to roll down track 21 past an acceptance window 28. As more fully explained in the above-identified patents, coins of the smallest diameter acceptable denomination — for example U.S. 10-cent pieces — fall from the track 21 through a window 28 and into the associated coin tube 86. Larger diameter coins — for example the U.S. 5-cent and 25-cent pieces — cannot fall through the window 28, and so pass it by and fall from the end 22 of the track 21 down a second cash box passageway 75 into the cash box (not shown) below.

If the coin has been identified as unacceptable by the coin presence sensor 30, the first gate 24 remains in the first gate's first position, which obstructs the entrance to the accepted coin passageway 54, and permits the coin to strike and roll down the upper face of the first gate 24 onto a track 16 in the rejected coin passageway 64. The track 16 conveys the rejected coin to the reject coin chute 46, which delivers the rejected coin to the coin return window of the vending machine (not shown).

Figure 3:
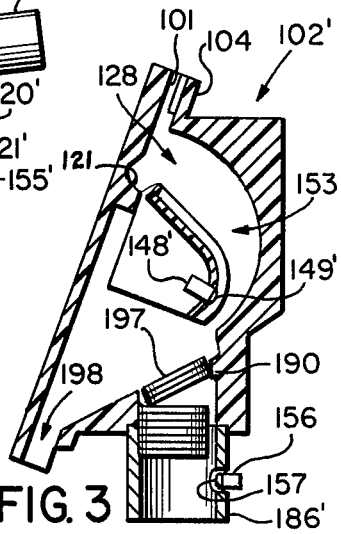
FIG. 3 is a simplified sectional view taken along the line 2—2' of a portion of an apparatus similar to that of FIG. 2.

The second gate 25 permits only accepted coins moving with normal velocity to enter into the coin containers and filling mechanism 5. The filling mechanism is provided with a fullness detector 56 on the coin tube 86 or other form of jam detector. FIG. 3 shows a typical fullness detector 156 (on a coin tube 186'), similar to fullness detector 56. Fullness detector 156 comprises a light emitting diode (LED) and a phototransistor assembled in a single package with the light emitting and sensing surface 157 directed toward the interior of the top coin tube 186', where the presence or absence of a coin is detected by reflected light. When coin presence is detected in coin tube 186' by the fullness detector 156 any additional acceptable coins received by the apparatus are sent directly to the cash box.

If a coin is identified as acceptable by the coin presence sensor 30 of the embodiment of FIG. 1, a signal responsive to the output of the coin presence sensor 30 is transmitted by wire 31 to set the flip-flops 32 and 33, and to trigger the first delay circuit 42. When flip-flop 32 is set, the first actuator 44 is activated via wire 34 causing the first gate to move from its first position, in which it would divert coins to the reject passageway 64, to its second position in which it permits coins to pass into the accepted coin passageway 54. After a delay of a sufficient period for an acceptable coin moving with normal velocity, to pass from the coin presence sensor 30 past the first gate 24, typically 0.1 second, the first delay circuit 42 produces a signal which resets flip-flop 32, deactivating the first actuator 44 and causing the first gate 24 to return to its first, coin rejecting position.

The signal from the coin presence sensor 30 having set flip flop 33, a signal is transmitted via wire 35 to activate actuator 45. When actuator 45 is activated, the second gate 25 is moved from its first position in which coins enter the first cash box passageway 55 to its second position in which coins are directed to the coin container filling mechanism 5 via coin container passageway 65.

The signal from the first delay circuit 42 is also applied to the inputs of a first AND-gate 36 and a second AND-gate 37. The first AND-gate 36 produces an output signal when a signal is received from the delay circuit 42 concurrently with a signal from coin tube fullness detector 56 that the coin tube 86 is full or jammed at the top, in which case the signal causes the second gate 25 to be returned to its first position in which the coins enter the first cash box passageway 55 before the second gate 25 can divert the coin into the coin container passageway 65. The second AND-gate 37, which has an inverting input 38, produces an output signal when it concurrently receives a signal from the delay circuit 42 on one input and no signal (indicating the absence of coins) from the fullness detector 56. The output signal from the second AND-gate 37 initiates the second delay circuit 39, which produces an output signal after a sufficient period of an acceptable coin of normal velocity to pass the second gate 25 into the coin container passageway 65, typically 0.4 second. The output signal from the second delay circuit 39 is applied via OR-gate 40 to reset the second flip-flop 33, and thereby return the second gate 25 to its first position.

Figure 2:
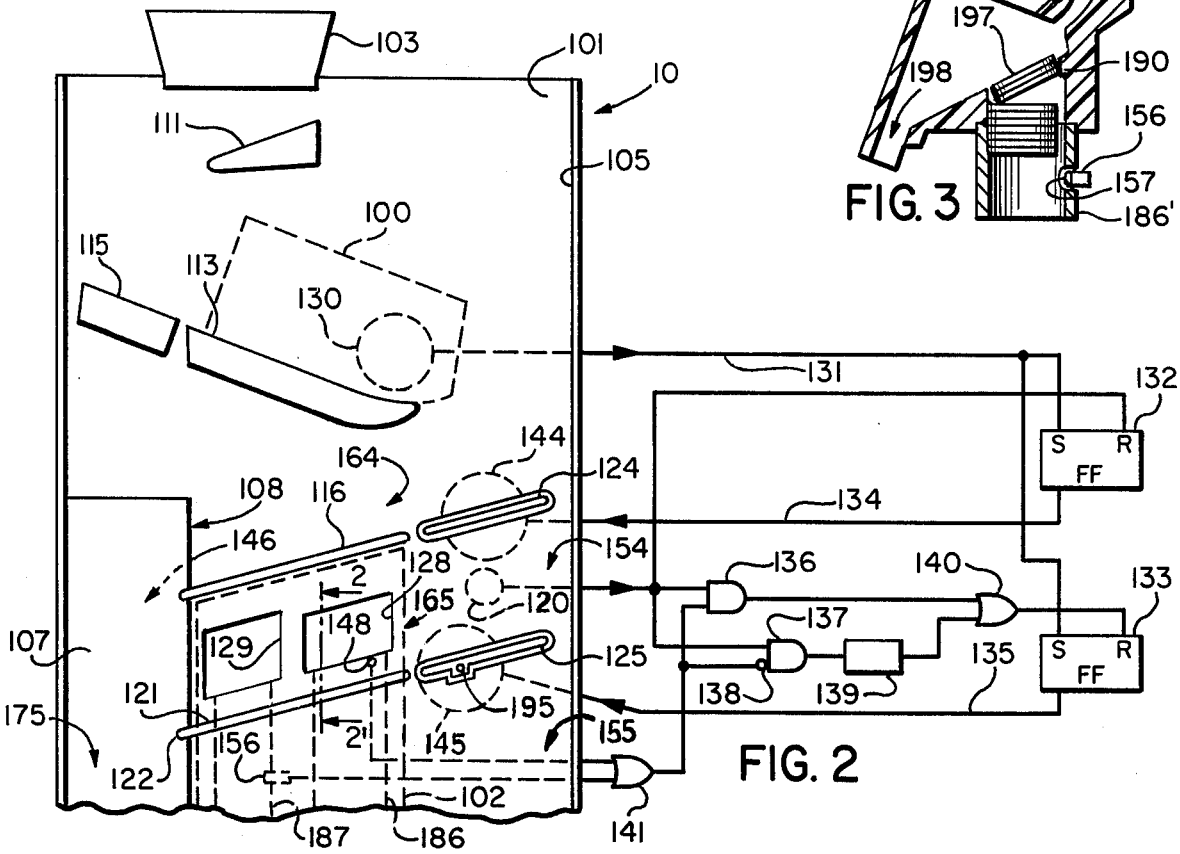
FIG. 2 is a simplified partial rear elevational view of an apparatus including the present invention and a schematic block diagram of its electric circuitry.

FIG. 2 shows a partial rear elevational view of an apparatus 10, simplified by the removal of sidewall 104 which could ordinarily obscure most of the apparatus from the viewer, and by the schematic placement of the various components on sidewall 101; although a number of the components may be conveniently placed on sidewall 101 without departing from the invention, as described with respect to FIG. 4 below.

Figure 4:
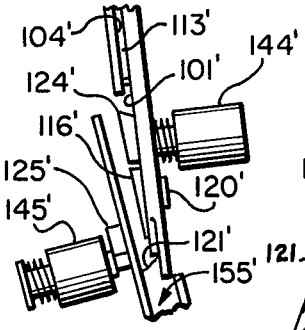
FIG. 4 is a simplified side view of the gate region of an apparatus similar to that of FIG. 2.

FIG. 4 shows a side view of an embodiment similar to that of FIG. 2. The elements of FIG. 4 have been identified with a prime symbol following the numeral of the corresponding element in FIG. 2. FIG. 4 differs from FIG. 2 principally in that where the gates 124 and 125 and actuators 144 and 145 were shown on the same side of the passageways in FIG. 2, for simplicity, the second gate 125' and its actuator or solenoid 145' are located on the opposite side of the passageway from the first gate 124' and its actuator 144' in FIG. 4.

A coin inserted into the coin-receiving slot (not shown) of an apparatus incorporating the present invention such as a vending machine, is directed into a hopper 103 of the coin handling apparatus 10. The coin drops from the hopper 103 onto a track 111 and rolls down the track between front and rear sidewalls or plates 101 and 104. At the end of track 111 the coin drops onto a pad 115. Both track 111 and pad 115 absorb or dissipate a substantial portion of the kinetic energy of the falling coin to reduce coin bouncing, for example, in the manner described in U.S. Pat. No. 3,889,792 or No. 3,944,038. The coin rolls down the upper surface of the pad 115 and onto a track 113. As the coin rolls downstream along the track 113, it is identified by a coin tester 100 including one or more coin presence sensors 130 in a region above the track 113. By the time the coin reaches the end of the track 113, the presence of the coin has been identified and the coin has been further identified by the coin tester as either acceptable or unacceptable, and if acceptable, the coin has been further indentified as to denomination.

The first gate 124 is moveable by the solenoid 144 between two positions. In the embodiment of FIG. 2, the first gate is arranged to protrude in its first position from one of the sidewalls, either sidewall 101 or sidewall 104 (similar to sidewalls 101' and 104' in FIGS. 3 and 4) spaced from sidewall 101. In this first position, the first gate obstructs the entrance to the accepted coin passageway 154 and permits coins to pass only into the rejected coin passageway 164. When the first gate 124 is activated, it is moved into its second position, retracted from obstructing the entrance to the accepted coin passageway 154. The coins can then pass only into the accepted coin passageway 154.

Downstream of the first gate 124 is a further coin presence sensor 120 embedded in one of the sidewalls, sidewall 101 in FIG. 2, alongside the accepted coin passageway 154. Downstream of the coin presence sensor 120 and the first gate is a second gate 125.

When the second gate 125 is not activated, it is held in its first position, retracted from obstructing the entrance to the first cash box passageway 155. All accepted coins then pass to the cash box (not shown) via a first cash box passageway 155.

When the second gate 125 is activated by a second activator means or solenoid 145, it protrudes from the sidewall 101 or the other sidewall (not shown) across the entrance to the first cash box passageway 155, obstructing the entrance to the first cash box passageway 155 and permitting accepted coins to pass only to the coin container filling mechanism 102 via the coin container passageway 165. The accepted coin rolls down track 121 past acceptance windows 128 and 129 which are graded in height from smaller to larger. As more fully explained in U.S. Pat. Nos. 3,906,965 and 3,884,297, and shown in FIG. 3, coins of the smallest diameter acceptable denomination — for example U.S. 10-cent pieces — fall from the track 121 through a window 128 and down an associated coin chute 153 into the associated coin tube 186. Similarly, coins of the next larger diameter acceptable denomination — for example U.S. 5-cent pieces — fall down from the track 121 through a window 129 down an associated coin chute (not shown) into the associated coin tube 187. Larger diameter coins — for example the U.S. 25-cent piece — cannot fall through the windows 128 and 129; and so pass them by and fall from the end 122 of the track 121 down a second cash box passageway 175, in front of a sidewall or partition 107, into the cash box (not shown) below.

If the coin has been identified as unacceptable by the coin tester 100, the first gate 124 remains held in the first gate's first position by the return spring of the solenoid or an actuator 144. The first gate 124 then obstructs the entrance to the accepted coin passageway 154, and permits the coin to strike and roll down the upper face of the first gate 124 onto a track 116 in the rejected coin passageway 164. The track 116 conveys the rejected coin to the opening or entrance 108 of the reject coin chute 146, which passes behind the partition 107 and the second cash box passageway 75 in FIG. 1, and delivers the rejected coin to the coin return window of the vending machine (not shown).

The second gate 125 operates in a fashion similar to the second gate 25 of the embodiment of FIG. 1. In its first or rest position, the second gate 125 is retracted into a recess on sidewall 101 of the coin handling apparatus, permitting coins to pass only into the first cash box passageway 155. In its second position, the second gate 125 protrudes from the sidewall 101, obstructing the entrance to the first cash box passageway 155, so that on arriving coin will strike the upper surface of the second gate 125 and, unless the second gate 125 is quickly withdrawn to its first position, the coin will be diverted into the coin container passageway 165.

Figure 5:
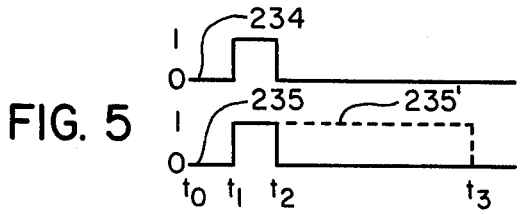
FIG. 5 is a timing diagram for the operation of one embodiment of the invention.

When the furthest downstream coin presence sensor 130 of the coin tester 100 indicates the completion of testing of an acceptable coin of a denomination which it may be desireable to direct to the coin container passageway 165, the coin tester 100 sends a signal via wire 131 to set flip-flop 132 and 133. When flip-flop 132 is set, it sends a signal via wire 134 to actuator 144, which moves the first gate 124 from its first or reject position to its second or accept position. This occurs at time $t_0$, in the timing diagram of FIG. 5, in which line 234 represents the signal state on wire 134. The second flip-flop is also set at a time $t_1$ by the signal from the coin tester 100, sending a signal via wire 135 to activate the actuator 145, thereby moving the second gate from its first position to its second position. The signal state on wire 135 under these conditions is shown by line 235 in FIG. 5.

Coin presence sensor 120 is located in a position where it can identify the presence of a coin in the path between the first and second gates. When the coin presense sensor 120 identifies the presence of a coin, at $t_2$ in FIG. 5, it causes a signal to be sent to the first flip-flop 132 to reset it. Since actuator 144 is then no longer activated, it causes the first gate 124 to return to its first or reject position. of The apparatus of FIG. 2 employs a coin tube fullness detector 156 on 5-cent coin tube 187, as previously described with respect to FIG. 3, and a jam detector 148 on the 10-cent coin tube 186. The jam detector 148 comprises a LED and a photosensor, and may be of the type and in the location on coin tube 186 corresponding to that of detector 148' on coin tube 186' in FIG. 3. Detector 148' which has a light emitting and sensitive surface 149' directed toward coin tube loader passageway (coin chute) 153. In the event that the coin tube 186' in FIG. 3 is jammed or full, as shown in that figure, further coins arriving through window 128 will normally slide over the surface of the top coin 197 and exit through passageway 198 to the cash box. In the event that a jam occurs at the top of the coin tube 186', the jam detector 148' will detect the jam as it extends into the coin tube loader passageway 153 and would function with the logic circuits in the same manner of fullness detector 156 to prevent the second gate 125 from moving into its second position while the jam persists. Other types of known coin tube fullness or jam detectors may also be employed. In the case of all types of fullness detectors, coin jams and backups in the vicinity of the coin tube tops are detected at an early stage and, since no further coins are directed to the coin container filling mechanism 102 while a jammed condition persists, the normal dispensing of coins is likely to clear the condition.

The signal from the coin presence sensor 120 is also applied to the inputs of a first AND gate 136 and a second AND-gate 137. The first AND-gate 136 produces an output signal when a signal is received from the coin presence sensor 120 concurrently with a signal via OR-gate 141 either from a coin tube fullness detector 156 that the coin tube 187 is full or a coin jam detector 148 that a coin tube 186 jammed at the top, in which case the signal causes the second gate 125 to be promptly returned to its first position so that the coin enters the first cash box passageway 155 before the second gate 125 can divert the coin into the coin container passageway 165.

In the event that a moving coin in the accepted coin passageway 154 is not immediately detected by the coin presence sensor 120, as may happen particularly with small coins such as the U.S. 10-cent piece, the coin strikes the second gate 125. This will slow the coin sufficiently to permit identification of its presence by the coin presence sensor 120. In the event that a coin jam is detected as a coin tube is full, as described above, the second gate 125 is immediately moved to its first position before the coin can roll into the container passageway 165, causing it to fall into the first cash box passageway 155. In order to avoid having the coin bounce from the second gate 125 into the container passageway 165, the second gate is designed to absorb or dissipate the kinetic energy of the coin upon impact, for example, as disclosed in U.S. Pat. No. 3,889,792, or U.S. Pat. No. 3,944,038. Alternatively, the second gate 125 may be formed of relatively stiff material such as aluminum in the shape shown generally in FIG. 2, mounted so that the gate can pivot about the axis of the solenoid shaft 195 of the activator 145. The solenoid axis is offset from the area of normal impact of coins on the second gate 125 so that the momentum of impinging coin is transferred to the second gate 125, thereby reducing coin bounce.

The second AND-gate 137, which has an inverting input 138, produces an output signal when it concurrently receives a signal from the coin presence sensor 120 on one input and no signal (indicating the absence of coins) from detector 156 or the coin jam detector 148. The output signal from the second AND-gate 137 initiates the delay circuit 139, which produces an output signal after a sufficient period for an acceptable coin of normal velocity to pass the second gate 125 into the coin container passageway 165, typically 0.4 second. The output signal from the second delay circuit 139 is applied via OR-gate 140 to reset the second flip-flop 133, and thereby return the second gate 125 to its first position. The signal on wire 135, which activates the actuator 145, retaining the second gate 125 in its second position during the period $t_2$–$t_3$, is shown by line 235' in FIG. 5.

I claim:

1. An improved coin apparatus comprising a structure defining a coin path, a coin tester for producing a first electrical signal indicative of coin acceptability, a cash box, a coin container for coins of a single denomination, a coin container filling apparatus, a first gate located downstream of the coin tester, the first gate being moveable between a first position permitting coins on the coin path to enter only a rejected coin path and a second position permitting coins on the coin path to enter only an accepted coin path, first activator means responsive to the first electrical signal for causing the first gate to move between the first and second positions, a second gate located downstream of the first gate in the accepted coin path, the second gate being moveable between a first position permitting coins on the accepted coin path to enter only a passageway leading directly to the cash box and a second position permitting coins on the accepted coin path to enter only a coin container filling apparatus passageway, second activator means for causing the second gate to move from the first position in which it is normally biased to the second position, a coin presence sensor located adjacent the accepted coin path between the first gate and the second gate, and circuit means responsive to the coin presence sensor for producing a second electrical signal indicative of the presence of an acceptable coin on the path in the vicinity of the coin presence sensor, wherein the first electrical signal causes the second activator means to be energized thereby moving the second gate from its first position to its second position, and first time delay means initiated by the second electrical signal for deenergizing the second activator means a predetermined period of time after a coin is first detected by the coin presence sensor.

2. The apparatus of claim further comprising a jam detector arranged to detect jams in the coin container filling apparatus and first logic gate means connected to receive a signal from the jam detector indicative of the presence of a jam, wherein the first logic gate means is connected to deenergize the second activator means.

3. The apparatus of claim 1 further comprising a coin container fullness detector and second logic means connected to receive a signal from the fullness detector indicating that the container is filled, wherein the second logic gate means is connected to deenergize the second activator means.

4. The apparatus of claim 1 wherein the actuators are of the self-returning type which hold the first gate in its first position except when the first activator is energized, and hold the second gate in its first position except when the second activator is energized.

5. The apparatus of claim 1 further comprising a second time delay means connected to receive the first electrical signal and for producing an electrical signal which is connected to deenergize the first activator means at the conclusion of a period of predetermined duration, thereby causing the first gate to return from its second position to its first position.

6. The apparatus of claim 5 wherein the actuators are of the self-returning type which hold the first gate in its first position except when the first activator is energized, and hold the second gate in its first position except when the second activator is energized.

7. The apparatus of claim 5 further comprising a coin container fullness detector and second logic gate means connected to receive a signal from the fullness detector indicating that the container is filled, wherein the second logic gate means is connected to deenergize the second activator means.

8. The apparatus of claim 7 wherein the coin container comprises at least one coin tube from which coins can be dispensed, the coin tube being fillable from the coin container filling apparatus passageway.

9. The apparatus of claim 1 further comprising at least one sidewall defining a portion of the coin path adjacent the first gate, wherein the first gate protrudes from the sidewall in its first position and is withdrawn into a recess in the sidewall in its second position.

10. The apparatus of claim 1 further comprising at least one sidewall defining a portion of the coin path adjacent the second gate, wherein the second gate protrudes from the sidewall in its second position and its withdrawn into a recess in the sidewall in its first position.

11. The apparatus of claim 1 further comprising a first sidewall and a second sidewall spaced from each other and defining a portion of the coin path in the vicinity of the first and second gates, wherein the first gate protrudes from the first sidewall in its first position and the second gate protrudes from the second sidewall in its second position.

12. The apparatus of claim 1 further comprising a first sidewall and a second sidewall spaced from each other and defining a portion of the coin path in the vicinity of the first and second gates, wherein the first gate protrudes from the first sidewall in its first position and in its second position is withdrawn into a recess in the first sidewall, the second gate is withdrawn into a recess in the second sidewall in its first position and its second position protrudes from the second sidewall.

* * * * *

UNITED STATES PATENT AND TRADEMARK OFFICE

CERTIFICATE OF CORRECTION

PATENT NO. : 4,106,610

DATED : August 15, 1978

INVENTOR(S) : FREDERIC P. HEIMAN

It is certified that error appears in the above-identified patent and that said Letters Patent are hereby corrected as shown below:

Col. 1, line 46, change "coils" to --coins--.

Col. 2, line 28, change "passagewy" to --passageway--.

Col. 6, line 45, after "position." delete "of".

Col. 8, Claim 2, line 28, after "claim" insert --1--.

Col. 9, Claim 10, line 7, after "and" change "its" to --is--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*